United States Patent [19]

Clayton et al.

[11] Patent Number: 4,978,813

[45] Date of Patent: Dec. 18, 1990

[54] ELECTRICAL CABLE

[75] Inventors: Donald L. Clayton, Phoenix; Dinesh Shah, Chandler, both of Ariz.

[73] Assignee: W. L. Gore & Associates, Inc., Newark, Del.

[21] Appl. No.: 400,247

[22] Filed: Aug. 29, 1989

[51] Int. Cl.[5] ..... H01B 7/08

[52] U.S. Cl. ..... 174/117 F; 156/55; 156/56; 174/110 R; 174/110 SR

[58] Field of Search ..... 174/117 F, 117 FF, 110 FC, 174/110 R, 110 SR, 120 R, 120 SR; 156/51, 55, 56

[56] References Cited

U.S. PATENT DOCUMENTS

| | | | |
|---|---|---|---|
| 3,792,409 | 2/1974 | Smart et al. | 174/107 X |
| 3,857,996 | 12/1974 | Hansen et al. | 174/120 SR X |
| 3,914,363 | 10/1975 | Bedard et al. | 174/120 SC X |
| 3,980,807 | 9/1976 | Woytiuk | 174/107 |
| 4,010,619 | 3/1977 | Hightower et al. | 174/110 FO X |
| 4,250,351 | 2/1981 | Bridges | 174/106 R |
| 4,281,210 | 7/1981 | Brauer et al. | 174/110 SR X |
| 4,306,923 | 12/1981 | MacPherson | 174/47 X |
| 4,423,282 | 12/1983 | Suzuki et al. | 174/120 SR X |
| 4,447,122 | 5/1984 | Sutehall | 174/121 A X |
| 4,529,564 | 7/1985 | Harlow | 174/110 FC X |
| 4,584,241 | 4/1986 | Choi et al. | 174/120 SR X |
| 4,639,693 | 1/1987 | Suzuki et al. | 174/117 F X |
| 4,741,594 | 5/1988 | Suzuki | 350/96.23 |
| 4,924,037 | 5/1990 | Ainsworth et al. | 174/117 F |

FOREIGN PATENT DOCUMENTS

| | | | |
|---|---|---|---|
| 2614807 | 10/1977 | Fed. Rep. of Germany | 174/120 R |

*Primary Examiner*—Morris H. Nimmo

*Attorney, Agent, or Firm*—Gary A. Samuels

[57] ABSTRACT

An electrical cable of conductive wire having an insulating layer of expanded, microporous sintered polytetrafluoroethylene around it, followed by a coating of a polyesterpolyurethane surrounding the insulating layer, and an outer film of thermoplastic polyester elastomer surrounding the coating.

5 Claims, 1 Drawing Sheet

ELECTRICAL CABLE

FIELD OF THE INVENTION

This invention relates to electrical cable and to a method for preparing it.

BACKGROUND OF THE INVENTION

Heretofore, conductive electrical wire, such as copper wire, has been coated with film of microporous, expanded polytetrafluoroethylene (PTFE) to provide an insulated wire. The PTFE coating provided a low dielectric, flexible, chemically resistant protective covering surrounding the conductive wire. This assembly is then ordinarily provided with an outer insulative covering of full density, non-expanded polytetrafluoroethylene to provide a covering that is heat resistant, is chemically inert, is resistant to being cut (called cut-through resistance) and is of long flex life. This configuration is particularly useful for flat or ribbon cable, such as is described in U.S. Pat. No. 4,443,657.

It is desirable to provide a cable that has the attributes of the above-described cable and has substantially improved abrasion resistance, further improved cut-through resistance, high coefficient of kinetic friction, and increased stiffness.

The invention herein possesses these desirable features.

SUMMARY OF THE INVENTION

An electrical cable comprising:

(a) at least one conductive wire, (b) an insulating layer surrounding the conductive wire, said insulating layer comprising expanded, microporous sintered polytetrafluoroethylene, (c) a primer coating of a polyesterpolyurethane surrounding the insulating layer.

(d) an outer coating covering and surrounding the primer coating comprising a film of thermoplastic polyester elastomer.

DETAILED DESCRIPTION OF THE INVENTION

The cable of the present invention is particularly adaptable for use where ribbon or flat cable containing a plurality of parallel wire conductors in coplanar configuration are desired. One advantage of the cable of this invention is the excellent abrasion resistance that is achieved, while further improving the good cut-through resistance of previous cable constructions. The cable of this invention also shows higher coefficient of kinetic friction than other cables with the above properties, and shows increased stiffness than other cables with the above properties.

Figure 1:
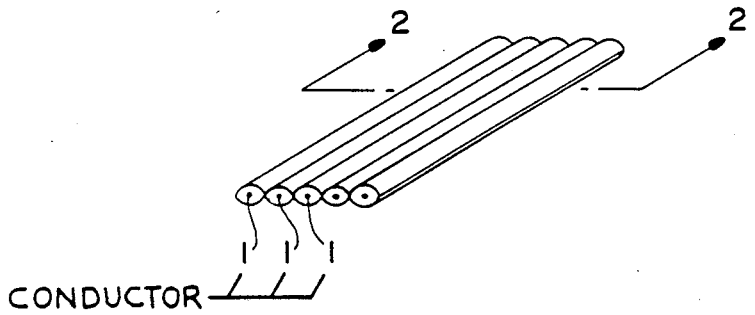
FIG. 1 represents a three dimensional perspective view of one embodiment of the cable of this invention.
Figure 2:
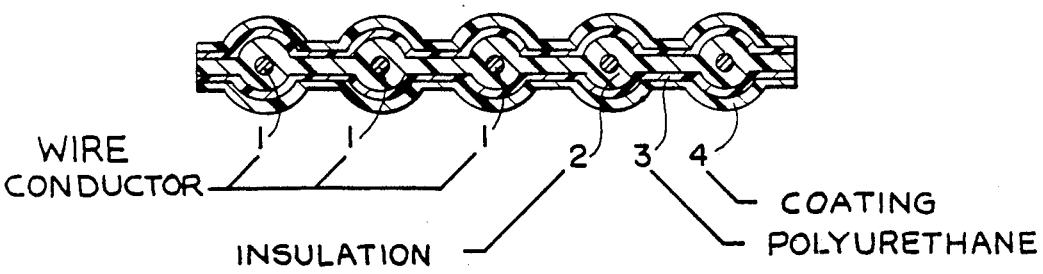
FIG. 2 represents a cutaway enlarged view of the cable of FIG. 1 taken along line 2—2 of FIG. 1.

With reference to FIGS. 1 and 2, there is provided a plurality of center wire conductors 1, surrounded by insulation of low dielectric 2 which is expanded, microporous polytetrafluoroethylene made generally as described in U.S. Pat. No. 3,953,566.

Surrounding the insulation 2 is a layer of primer coating of polyesterpolyurethane 3. A representative polyesterpolyurethane is Estane 5703 provided by B. F. Goodrich Co. This layer is ordinarily applied by solution coating, as for example, dip-coating the insulated wire in a solution of the polyesterpolyurethane. A typical solution of such polyurethane is a 5–20% by weight solution in a suitable organic solvent, such as a halogenated solvent, as for example, methylene chloride. Temperature and pressure are not critical.

The coating 3 is applied as a primer solution to enable the outer coating 4 to be applied with ease and good adherability. The primer coating 3 works its way partially into the pores of the microporous, expanded polytetrafluoroethylene and provides a firm interlocking bond therewith, thus, providing a firm foundation for the outer jacket coating 4.

The jacket coating 4 is a layer of thermoplastic polyester elastomer. A representative polyester elastomer is Hytrel 5556 supplied by E. I. duPont de Nemours and Company, Inc. The jacket may contain suitable filler material, such as flame retardants and fibrous materials. The outer coating 4 is applied as a melt extrudate and is bonded to polyesterpolyurethane primer coating 3 with the aid of vacuum. Preferably, a common flame-retardant is added to the jacket film, but such is not absolutely necessary.

The fabrication of the conductor cable includes the initial steps of embedding the conductors in separate top and bottom inner films of microporous unsintered PTFE and compressing the films. The cable is fabricated using initially unsintered layers of PTFE; the insulation layers 2 are made out of unsintered, expanded microporous PTFE. The flexible PTFE insulated ribbon cable can be produced in an advantageous manner in a one-step continuous process in that the conductors are embedded in two inner films of porous expanded, unsintered PTFE by combining those elements at room temperature in a roll nip under pressure. This assembly is then subjected to heat to sinter the PTFE.

The resulting insulated wire is then subjected to a primer coating solution of polyesterpolyurethane by any usual means. One such means is by immersing the insulated wire into the solution and passing the wire continuously through the solution. Room temperature and pressures are conveniently used. The resulting insulated wire now is coated with primer coating 3. The coated wire is dried to remove solvent.

Next a coating of thermoplastic polyester elastomer is extruded by passing the cable through an extrusion head. Temperature of the polyester elastomer extrudate may be 200° to 225° C. The extrudate comes into contact with the cable while still molten and makes a bond with the polyesterpolyurethane primer. The resulting assembly is then cooled.

EXAMPLE 1

37 conductors, each of 26 gage 7 strand bare copper wire obtained from Hudson International Conductors, Inc., spaced on 0.050 inch centers, were continuously coated with 2 layers of expanded microporous 0.006 inch thick PTFE tape obtained from H. L. Gore & Associates, Inc., Newark, Del., by passing the wires and the tape on each side thereof through the nip of 2 compression rolls at 80 pounds pressure at a pull weight of about 20 pounds, and then the PTFE layers were sintered by feeding into a bath of molten salt at about 400° C. at a line speed of about 15 feet per minute and then cooled by subjecting to water at 15° C. This procedure embeds the conductors between the 2 layers of PTFE tape. The two PTFE layers are bonded by the sintering process.

The laminated wire was then dipped in a solution of polyesterpolyurethane (Estane 5703) and methylene chloride, at a line speed of about 4 feet per minute, at room temperature and pressure. The cable was then dried by means of two hot air guns at about 149° C.

The primer coated cable was then passed through the head of a screw extruder, with zone temperatures of 205, 206, 208, 210, 215, and 215° C., at a line speed of about 40 feet per minute, and withdrawn under vacuum. The polyester elastomer(Hytel 5556) was extruded about the cable to forn an outer coating around the exposed cable surfaces.

The abrasion resistance of the cable assembly was determined by MIL-T-5438. The cable was too wide to fit the testing machine and was slit to provide 8 conductors in the cable assembly. One side of the assembly had a thickness of 13.5 mils (average). The amount of abrasive tape used before the tape wore through was 218 inches (average).

In the Tabor stiffness test, the stiffness values obtained resulted in an average stiffness of 86.6 grams centimeters. The coefficient of friction, as determined by ASTM D-1894 was 2.8020. The cut-through resistance was good.

We claim:

1. An electrical cable comprising:

(a) at least one conductive wire, (b) an insulating layer surrounding the conductive wire, said insulating layer comprising expanded, microporous sintered polytetrafluoroethylene, (c) a primer coating of a polyesterpolyurethane surrounding the insulating layer, (d) an outer coating covering and surrounding the primer coating comprising a film of thermoplastic polyester elastomer.

2. The cable of claim 1 wherein the polyesterpolyurethane coating is formed from a solution of the polyesterpolyurethane in an organic solvent.

3. The cable of claim 1 wherein the polyesterpolyurethane thermoplastic polyester elastomer film is extruded onto the polyesterpolyethane coating.

4. An electrical cable comprising a series of side-by side parallel conductive wires arranged in a coplaner configuration to form a flat construction; said wires covered and surrounded by an insulative layer of expanded, microporous polytetrafluoroethylene; said insulative layer covered by a covering of a polyesterpolyurethane; said cable having an outer layer of thermoplastic polyester elastomer coating which forms a solid protective film coating surrounding the assembly within.

5. A process for making an electrical cable which comprises:

(a) applying microporous expanded polytetrafluoroethylene tape around a conductive wire to form an insulative coating of microporous, expanded polytetrafluoroethylene, (b) subjecting the coated wire to a solution of a polyester polyurethane and drying the resulting assembly, (c) applying of a thermoplastic polyester elastomer around said resulting assembly in a manner that encapsulates said assembly.

* * * * *